United States Patent [19]

Smith

[11] 4,348,962

[45] Sep. 14, 1982

[54] RAILWAY HOPPER CAR BOLSTER ASSEMBLY

[75] Inventor: Stephen W. Smith, Carrollton, Tex.

[73] Assignee: Trinity Industries, Inc., Dallas, Tex.

[21] Appl. No.: 44,257

[22] Filed: May 31, 1979

[51] Int. Cl.[3] ..... B61D 7/04; B61F 1/10; B61F 1/12

[52] U.S. Cl. ..... 105/248; 105/406 R; 105/414; 105/419; 105/421

[58] Field of Search ..... 29/469; 105/247, 248, 105/253, 355, 358, 360, 406 R, 409, 414, 419; 280/5 C, 5 D; D12/41

[56] References Cited

U.S. PATENT DOCUMENTS

| | | | |
|---|---|---|---|
| 135,717 | 2/1873 | Lamason | 105/360 |
| D. 201,477 | 6/1965 | Mowatt-Larssen et al. | D12/41 |
| D. 201,478 | 6/1965 | Mowatt-Larssen et al. | D12/41 |
| 799,905 | 9/1905 | Holbrook | 105/360 |
| 1,139,457 | 5/1915 | Ledwinka | 105/406 R X |
| 2,011,076 | 8/1935 | Prescott | 105/360 X |
| 2,037,024 | 4/1936 | Holby | 280/5 D |
| 2,095,624 | 10/1937 | Young | 105/419 |
| 2,105,302 | 1/1938 | Thwaits | 280/5 C X |
| 2,108,416 | 2/1938 | Smith et al. | 105/358 X |
| 2,169,500 | 8/1939 | Reid | 280/5 C |
| 2,804,025 | 8/1957 | Delo, Jr. | 105/409 |
| 2,953,996 | 9/1960 | Allen | 105/406 R X |
| 3,139,286 | 6/1964 | Johnson | 105/360 X |
| 3,339,499 | 9/1967 | Charles et al. | 105/248 |
| 3,427,994 | 2/1969 | Keene | 105/414 X |
| 3,490,387 | 1/1970 | Halcomb | 105/248 |
| 3,495,548 | 2/1970 | Rollins | 105/360 X |
| 3,509,827 | 5/1970 | Sutter | 105/409 X |
| 3,515,051 | 6/1970 | Pulcrano | 105/360 X |
| 3,543,692 | 12/1970 | Stark et al. | 105/248 |
| 3,577,932 | 5/1971 | Pulcrano et al. | 105/253 |
| 3,583,331 | 6/1971 | Mowatt-Larssen | 105/360 |
| 3,605,634 | 9/1971 | Johnson | 105/248 |
| 3,713,399 | 1/1973 | Bembridge et al. | 105/358 |
| 3,844,229 | 10/1974 | Martin | 105/248 |
| 3,914,847 | 10/1975 | Martin | 29/469 |
| 3,995,541 | 12/1976 | Coyle et al. | 105/355 X |
| 4,003,319 | 1/1977 | Campbell et al. | 105/360 X |

*Primary Examiner*—Joseph F. Peters, Jr.
*Assistant Examiner*—Howard Beltran
*Attorney, Agent, or Firm*—Hubbard, Thurman, Turner, Tucker & Glaser

[57] ABSTRACT

A railway hopper car is disclosed which includes a car body defined by opposite arcuate side sheets having a side sill extending longitudinally along the lower margin of each side sheet and at least a first end slope sheet partially defining an end hopper compartment. An end support structure for the end hopper compartment is secured to the car body and includes a shear plate extending transversely between the side sills, a stub center sill disposed subjacent the shear plate, a bolster beam extending laterally on either side of the stub center sill and interconnecting the stub center sill with the side sill, a vertical bolster web interconnecting the stub center sill and the shear plate, an additional vertical bolster web assembly interconnecting the stub center sill, the shear plate, and the bolster beam, and a plurality of vertical gusset plates interconnecting the slope sheet and shear plate. The gusset plates project perpendicular to the shear plate and are disposed in spaced, parallel relation to each other in an array which extends laterally with respect to the longitudinal axis of the car.

12 Claims, 8 Drawing Figures

RAILWAY HOPPER CAR BOLSTER ASSEMBLY

BACKGROUND OF THE INVENTION

1. Field of the Invention

The present invention relates to railroad hopper car construction, and more particularly relates to the construction of a bolster assembly for supporting the overhanging end hopper compartments at opposite ends of the car.

2. Description of the Prior Art

Railway hopper cars are generally constructed having a series of adjacent hopper compartments defined by arcuate or curved side sheets and subdivided internally by bulk heads having an inclined portion. Slope sheets are provided at opposite car ends. Bottom hopper outlet adapters are arranged beneath the car for the discharge of lading material from the compartments. The outlet adapters are located so that the inclined bottom portions of the individual compartments funnel the material into the discharge opening.

According to conventional construction, an end support structure is secured to the end slope sheets at opposite ends of the car. The end structure serves to support the hopper car construction and to receive the draft gear coupler structure and the truck coupling. The end structure is designed to withstand buff and impact loads exerted at the coupler during operation of the hopper car. It is also designed to transmit the vertical load imposed by the car body and cargo.

Various conventional end structures are known in the art, for example as disclosed in U.S. Pat. No. 3,339,499. This patent discloses a covered hopper railway car having a bolster assembly extending between the side sills at either end of the car near the bottom of the slope sheet. The bolster assembly includes a lower cover plate and an upper generally horizontal shear plate. An end or center sill assembly receives a draft gear and coupler structure. A pair of diagonal end struts or gussets extend between the shear plate and end sheet, converging inwardly from the end sheet to the shear plate.

Various modifications to this prior art structure are known. For example, U.S. Pat. No. 3,490,387 discloses a covered hopper car construction utilizing diagonal struts or gussets as described above and further shows the use of a substantially vertical transverse web member extending between the end slope sheet and center sill structure inward of the diagonal gussets. In this construction, the stub center sill is longitudinally spaced from the end slope sheet thereby forming an open type torque box wherein loads transmitted through the stub center sill, shear plate, bolster web and slope sheet are taken up by the diagonal gussets which extend between the slope sheet and the shear plate.

Yet another railway hopper car end structure is disclosed in U.S. Pat. No. 3,844,229 in which the end supporting structure includes a bolster assembly having a bottom plate extending transversely between the side sills and an upper arcuate wrap sheet secured at the opposite side sheets and at the inclined slope sheet. Diagonal gusset plates and vertical web plates extend between the wrap and bottom sheets to strengthen the assembly. A plurality of generally semicircular diaphragm plates extend transversely between the wrap sheet and the slope sheet at locations above the car axis and the center plate to structurally stiffen the car body.

Because of the expense associated with the fabrication and assembly of a railway hopper car, there is a continuing interest in providing hopper car construction which is highly effective for accommodating operational loads while being relatively simple, lightweight, and having a minimum of structural elements. According to known prior art approaches, the through center sill has been eliminated in favor of the stub center sill and the side sills have been elevated relative to the stub center sill in order to reduce the height of the arcuate side sheets. The use of the stub center sill permits unobstructed hopper discharge. Utilization of the high side sills permits a substantial reduction in the size and weight of the arcuate side sheets. However, because of the difference in the elevation of the draft stub center sill and the side sills, a moment arm exists between the center line of the coupler and the shear plate. Because of this misalignment, the end of the car and the stub center sill is subject to a rotational moment which tends to force the assembly downwardly or upwardly upon the exertion of draft or buff forces against the car. This moment must be reacted by the end support structure to prevent structural damage. Therefore the end support structure must satisfy the functions of reacting the induced moment caused by the difference in elevation between the side sills and the stub center sill, it must distribute the load of the car and of the lading uniformly to a truck assembly upon which it rests, and it must distribute the draft and buff forces received through the coupling mechanism uniformly throughout the car and avoid concentration of stress. Also, it must react torsional forces applied to the coupling mechanism.

SUMMARY OF THE INVENTION

The foregoing objects and advantages are provided by the railway hopper car of the present invention which includes a car body defined by opposite arcuate side sheets having a side sill extending longitudinally along the lower margin of each side sheet and an end slope sheet partially defining an end hopper compartment. Combined with the car body is an end support structure for the end hopper compartment which includes a bolster assembly which features a shear plate secured between the side sills and also attached to the end slope sheet. A stub center sill is disposed beneath the shear plate substantially in alignment with the longitudinal axis of the car body. A first vertical bolster web assembly interconnects the stub center sill and the shear plate and a bolster beam extends laterally on either side of the stub center sill and interconnects the stub center sill with each side sill. A plurality of vertical gusset plates interconnect the end slope sheet and shear plate, with each of the gusset plates having a first edge portion attached to the end slope sheet and a second edge portion attached to the shear plate. The gusset plates are disposed in spaced parallel relation with respect to each other in an array which extends laterally with respect to the longitudinal axis of the car.

According to a preferred embodiment, a vertical bolster web assembly interconnects the stub center sill, the shear plate, and the bolster beam. The second vertical bolster web assembly is disposed intermediate the bolster beam and the shear plate and extends laterally with respect to the longitudinal axis of the car body.

The shear plate and stub center sill perform the primary function of coupling the draft and buff impact forces to the side sills. The first vertical bolster web assembly serves to uniformly distribute the load of an end of the car body through the shear plate to the stub center sill. The bolster beam provides subjacent support for the draft stub center sill and in combination with the second vertical bolster web assembly provide subjacent support for the shear plate. Furthermore, the combination of the bolster beam, the second vertical bolster web assembly, and shear plate constitute a mechanical couple for reacting torsional forces applied to the draft stub center sill. The plurality of vertical gusset plates serve to react the moment induced by the application of draft or buff forces through the offset stub center sill and also serve to uniformly distribute operational loads transmitted through the stub center sill and shear plate to the car body through the end slope sheet.

The novel features which characterize the invention are defined by the appended claims. The foregoing and other objects, advantages and features of the invention will hereinafter appear, and for purposes of illustration of the invention, but not of limitation, an exemplary embodiment of the invention is shown in the appended drawing.

DETAILED DESCRIPTION

Figure 1:
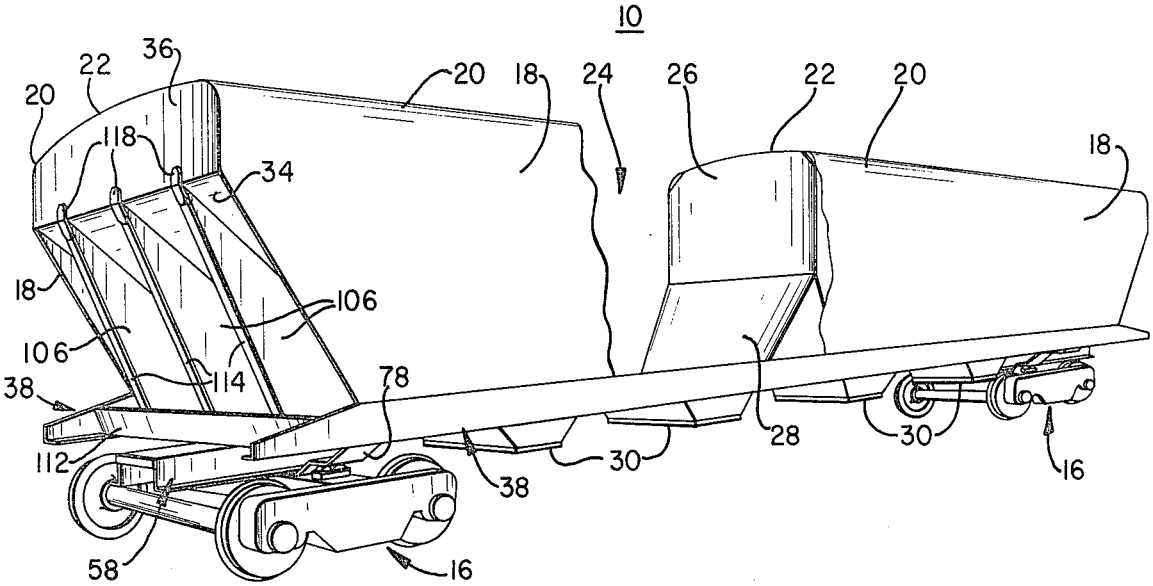
FIG. 1 is a perspective view of a hopper car, partly broken away, illustrating the bolster assembly of the present invention.

In the description which follows and in the several figures of the drawing, like parts are marked with the same reference numerals respectively.

Referring now to FIG. 1 of the drawing, a covered hopper railway car 10 having a car body 12 and an end bolster assembly 14 is illustrated. The car body 12 is mounted for movement on a wheel truck assembly 16 through a conventional pin and receiver coupler carried by the end bolster assembly 14.

The car body 12 includes opposite arcuate side sheets 18 joined at a top side sill structure 20 to which a roof sheet 22 is joined. The top side sill structure 20 is preferably in the form of a closed section defined by an upper curved extension of the roof sheet 22 which extends longitudinally along the car interior in the manner disclosed in U.S. Pat. No. 3,844,229 which is hereby incorporated by reference.

Intermediate hopper compartments, designated by the numeral 24, are defined between the side sheets 18 by vertical partitions or bulk heads 26 which include oppositely converging bottom inclined sheath portions 28 which terminate at a bottom discharge assembly 30 having conventional construction.

Figure 2:
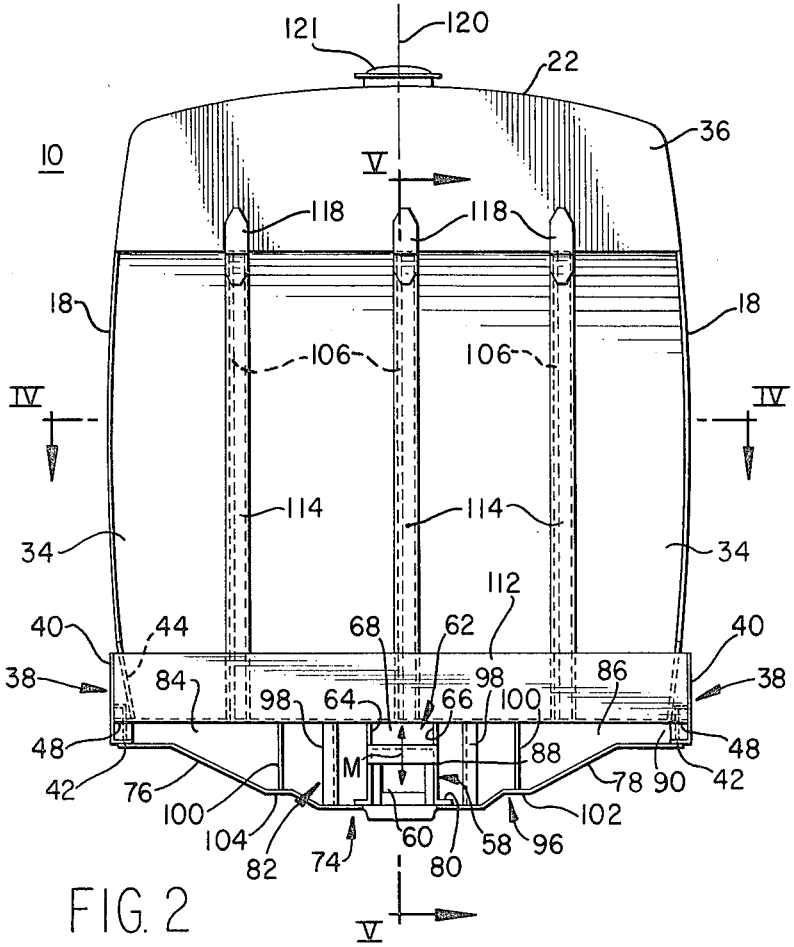
FIG. 2 is an end view, in elevation, of the hopper car shown in FIG. 1.
Figure 3:
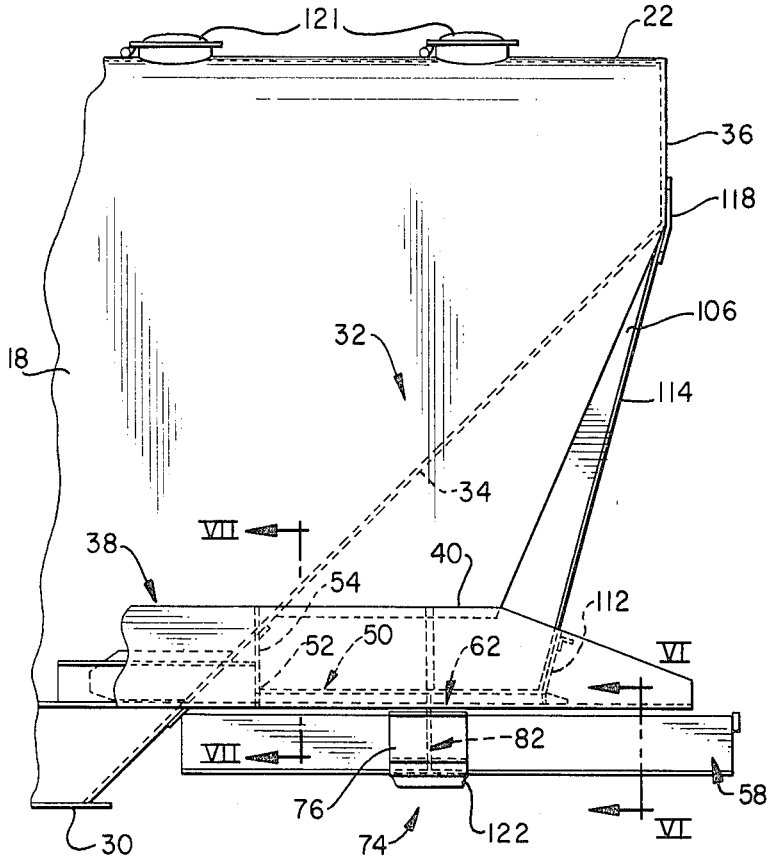
FIG. 3 is a partial side view of the hopper car shown in FIG. 1.
Figure 4:
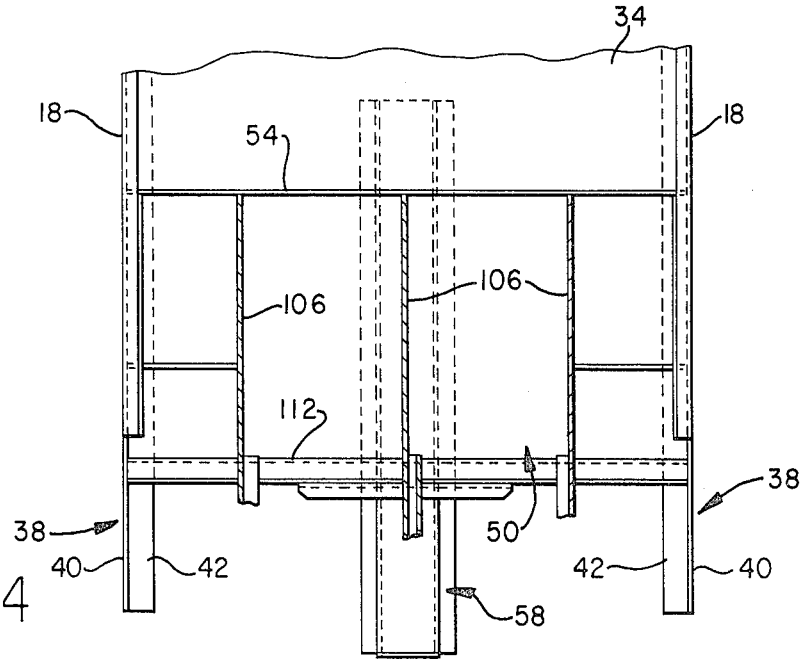
FIG. 4 is a sectional view of the bolster assembly for the hopper car of FIG. 1 taken along the lines IV—IV of FIG. 2.
Figure 5:
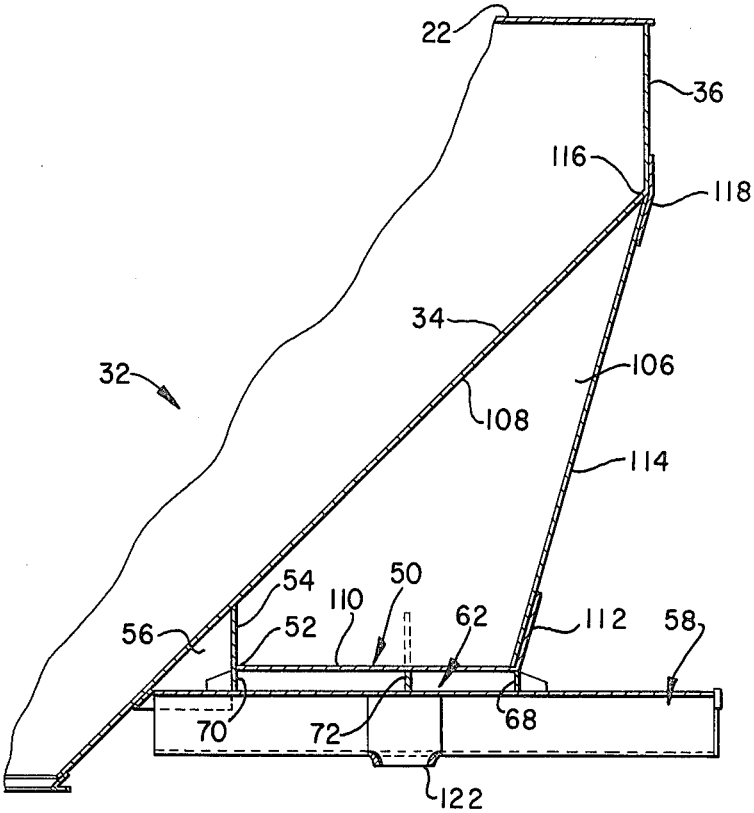
FIG. 5 is a sectional view of the bolster assembly taken along the lines V—V of FIG. 2.
Figure 6:
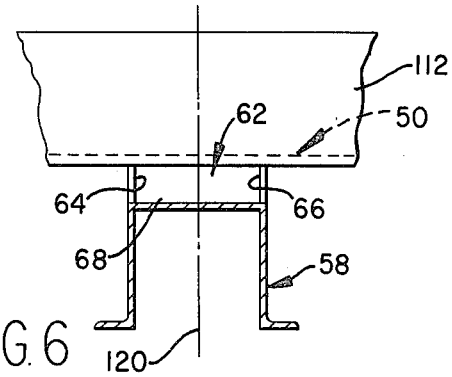
FIG. 6 is a sectional view of the stub center sill and shear plate assembly taken along the lines VI—VI of FIG. 3; and, FIG. 7 is a sectional view which illustrates the assembly of the side sheet, side sill, and shear plate which is taken along the line VII—VII of FIG. 3; and, FIG. 8 is an exploded perspective view of the bolster assembly shown in FIG. 1.

Referring now to FIGS. 1, 2 and 5, an end hopper compartment 32 is also defined between the arcuate side sheets 18 and is enclosed on one side by a vertical partition or bulk head 26 and converging bottom sheet portion 28 in a manner similar to the intermediate hopper compartments 24 but is enclosed on the opposite side by an inclined slope sheet 34 which together converge and terminate at a bottom discharge assembly 30. The slope sheet 34 includes a vertical end sheet portion 36. The inclined slope sheet 34 and vertical end sheet portion 36 are welded together and are also welded along their side edges to the arcuate side sheets 18, top side sill structures 20, and roof sheet 22.

Figure 7:
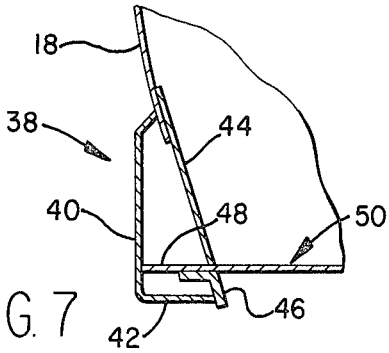

Side sills generally indicated by the numeral 38 extend the entire length of the car body 12 along the lower marginal edge of the side sheets 18. The side sills 38 are in the form of an angle having a vertical leg 40 and a shortened inwardly depending horizontal leg 42. As seen in FIG. 7 of the drawing, the side sheet 18 is joined to the side sill 38 by means of a longitudinal tie sheet 44 and an angle plate 46 in cooperation with an edge portion 48 of a shear plate 50 which will be further described hereinafter.

Referring now to FIGS. 2–5 and 8, the construction of the end bolster assembly 14 is illustrated. The bolster assembly 14 includes the shear plate 50 having the opposite side edge portions 48 and an inside lateral edge portion 52 mechanically connected to the inclined slope sheet 34. The shear plate 50 is mechanically connected to the slope sheet 34 by means of a first end sill 54, which is preferably an integral bend portion of the shear plate 50, and by an angle web assembly 56. The shear plate 50 is secured to the side sills and side sheet in the manner previously discussed and as illustrated in FIG. 7. A stub center sill 58 is disposed subjacent to the shear plate 50 and is in substantial alignment with the longitudinal axis of the car body 12. The stub center sill is equipped with a coupling bracket assembly 60 for receiving a conventional coupler and draft gear (not shown).

According to an important feature of the invention, a vertical bolster web assembly 62 interconnects the stub center sill 58 with the shear plate 50. As is best seen in FIGS. 2 and 5 of the drawing, the vertical bolster web assembly 62 is disposed intermediate the stub center sill 58 and the shear plate 50 and extends along the longitudinal axis of the car body beneath the shear plate. The vertical bolster web assembly 62 is generally coextensive with the lateral width of the stub center sill 58 and with the longitudinal extent of the shear plate 50. The vertical bolster web assembly 62 includes longitudinal webs 64, 66 which are disposed in spaced, parallel relation to each other, and a number of lateral webs including end lateral webs 68, 70 and one or more intermediate lateral webs 72. The lateral webs are generally perpendicular to the longitudinal webs 64, 66 and are disposed in spaced, parallel relation to one another. The longitudinal and lateral webs cooperate to interconnect the shear plate 50 with the stub center sill 58.

The stub center sill 58 is further supported by a bolster beam assembly 74 which includes first and second lateral bolster beams 76, 78. Each of the lateral bolster beams 76, 78 interconnect the stub center sill 58 to the corresponding side sill 38. The bolster beams extend laterally on either side of the stub center sill 58 and have a first end portion welded to a lip portion 80 and a second edge portion welded to be shortened horizontal leg 42 of the side sill 38.

According to another important feature of the invention, the stub center sill 58 is further strengthened and bolstered by means of an additional vertical bolster web assembly 82 which interconnects the stub center sill 58, the shear plate 50 and the bolster beam assembly 74. The vertical bolster web assembly 82 includes first and second lower bolster webs 84, 86 which extend laterally with respect to the longitudinal center line of the car body 12. The first and second lower bolster webs each have end portions 88, 90 attached to the stub center sill 58 and the adjacent side sill 38, respectively. Also, each of the lower bolster webs have an upper edge portion 92 and a lower edge portion 94 attached to the shear plate 50 and bolster beam 76, respectively.

The bolster assembly is further reinforced by a side bearing brace assembly 96 which includes a vertical angle plate 98 and a vertical stiffener plate 100 interconnecting the bolster beam 74, shear plate 50 and lateral bolster webs 84, 86 on each side of the stub center sill 58.

Each of the lateral bolster beams 76, 78 are folded and offset in the bearing areas 102, 104 for engaging roller bearings 105, 107 carried by the wheel truck assembly 16. Side bearing pads (not shown) may be attached in the side bearing areas 102, 104 to stabilize the car against lateral rocking. Torsional forces induced by lateral rocking of the car body 12 are reacted by the bolster beam assembly and the second vertical bolster web assembly in combination with the shear plate 50 and side sills 38.

The coupling bracket assembly 60 of the stub center sill 58 is adapted to receive conventional draft gear and coupler structure. It will be noted in FIG. 2 of the drawing that the stub center sill 58 is vertically offset with respect to the side sills 38 and shear plate 50 so that draft and buff forces are applied through a moment arm designated by the letter M. The moment induced by draft and buff forces tends to cause the end of the car to be rotated downwardly or upwardly upon the exertion of impact forces acting through the stub center sill 58. The load or coupler forces act on the stub center sill in either buff or draft (either impact or in pull). This load is transmitted to the sides 18 of the car by means of the shear plate 50. According to an important feature of the invention, the moment induced by these forces is reacted by a plurality of vertical gusset plates 106 which interconnect the slope sheet 34 and the shear plate 50. Each of the gusset plates 106 have a first edge portion 108 attached to the slope sheet 34 and a second edge portion 110 attached to the shear plate 50. The gusset plates 106 are disposed in spaced, parallel relation with respect to each other in an array which extends laterally with respect to the longitudinal axis of the car as can best be seen in FIGS. 1 and 2 of the drawing.

According to a preferred embodiment of the invention, a second end sill 112, which is preferably integrally formed as a bend portion of the shear plate 50, extends laterally between the side sills 38 and further interconnect the shear plate 50 and side sills 38. In this arrangement, each of the vertical gusset plates 106 includes an edge plate 114 which is attached to the second end sill 112. The edge plate 114 extends generally from the union 116 of the inclined slope sheet 34 and the vertical end sheet 36 downwardly to the shear plate 50 and second end sill 112. Each gusset plate 106 is joined to the vertical end sheet 36 by means of a cover plate 118. In this preferred embodiment, three gusset plates 106 are provided with one gusset plate being disposed substantially along the center line 120 of the car and the remaining two gusset plates 106 being equally spaced at intermediate lateral positions on either side of the center line 120.

Figure 8:
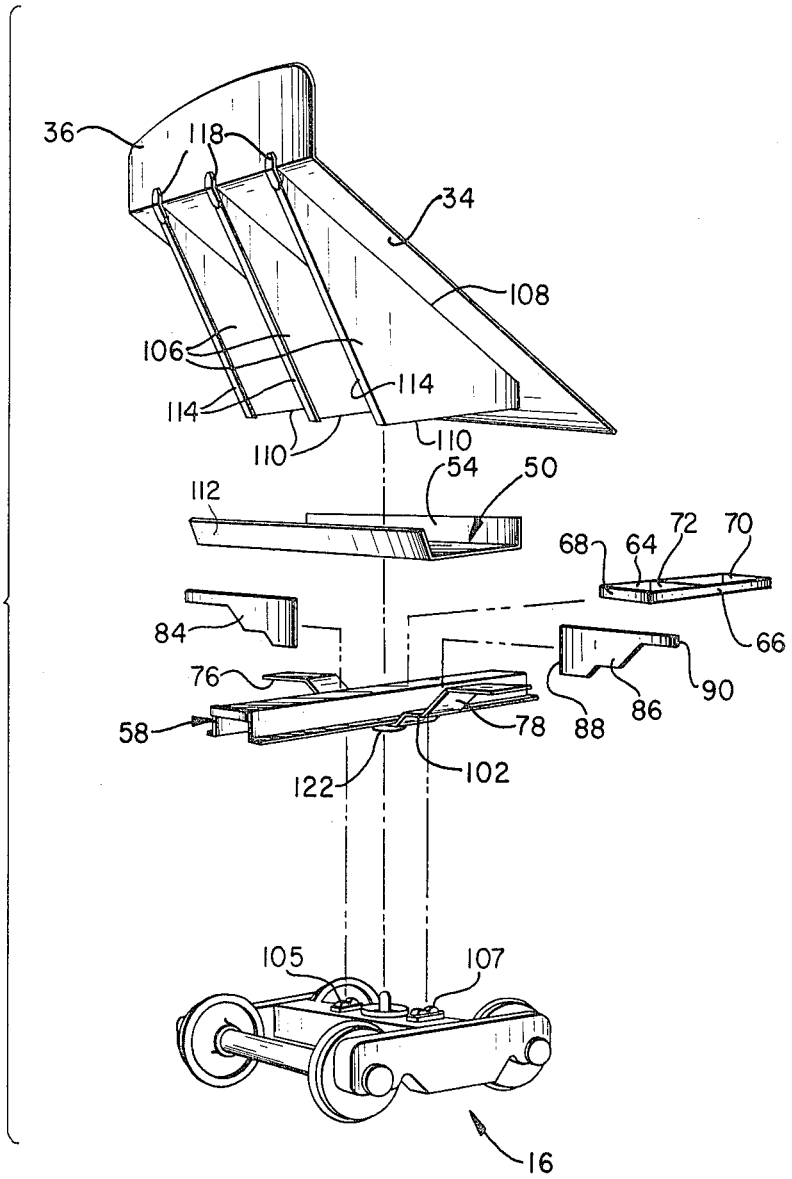

Longitudinally spaced hatch covers 121 are provided along the roof sheet 22 upon the center line 120 of the car according to conventional construction techniques for providing access to the interior of the hopper compartments 24. Suitable ladders and running boards (not shown) may also be provided to facilitate inspection and loading of the car. The stub center sill assembly 58 includes a center plate 122 for receiving a coupling pin carried by the wheel truck assembly 16 according to conventional construction techniques. The end bolster assembly 14 can be separately fabricated as a modular subassembly as shown in FIG. 8 which permits economy of shop space and convenience of assembly. Attachment of the components throughout the car is accomplished by welding. Prior to welding the subassemblies together, any relative adjustment to maintain proper tolerances and alignment can be made. For example, adjustment of the position of the end structure can be made to maintain the proper car height and length dimensions to conform with AAR standards.

It will be appreciated that the gusset plates 106 serve to reinforce the inclined slope sheet 34 to resist longitudinal forces imposed by car buff and impact loading. The gusset plates 106 also cooperate with the side sheets 18 and slope sheet to react the moment induced by buff and impact loading. Load forces transmitted through the shear plate 50 and stub center sill 58 to the wheel truck assembly 16 are distributed relatively uniformly by means of the vertical bolster web assemblies 62, 82 and the bolster beam assembly 74. Furthermore, the lateral bolster beams 76, 78 and bolster beam assembly 74 cooperate with the shear plate 50 to react torsional loads applied to the stub center sill. As a result, concentration of high stress loading is avoided. In addition, the vertical gusset plates 106 cooperate with the inclined slope sheet 34 and vertical end sheet 36 to substantially stiffen the outer shell defined by the combination of the roof sheet 22 and side sheets 18 thereby eliminating the requirement for additional structural reinforcing members.

Thus the present invention provides a hopper railway car construction which is particularly adaptable to modular construction. The structure is highly efficient in resisting operational loads imposed on the car while being relatively lightweight and having a minimum of structural elements.

Although a preferred embodiment of the invention has been described in detail, it should be understood that various changes, substitutions, and alterations can be made therein without departing from the spirit and scope of the invention as defined by the appended claims.

What is claimed is:

1. In a railway hopper car of the type including a car body defined by opposite arcuate side sheets having a side sill extending longitudinally along the lower margin of each side sheet and at least a first end slope sheet partially defining an end hopper compartment, the combination with the car body of an end support structure for the end hopper compartment, the end support structure including a bolster assembly comprising:

a substantially horizontally disposed shear plate having opposite side portions secured to the side sills, said shear plate forming a channel provided by a first upturned end portion forming a first end sill secured to the first end slope sheet and a second upturned end portion forming a second end sill;

a stub center sill disposed subjacent and connected to the shear plate substantially in alignment with the longitudinal axis of the car body;

a bolster beam extending transversely with respect to the longitudinal axis of the car body on either side of the stub center sill and interconnecting the stub center sill with each side sill;

a bolster web assembly interconnecting the stub center sill, the shear plate and the bolster beam;

a plurality of vertical gusset plates interconnecting the first end slope sheet and shear plate, each of the gusset plates having a first edge portion connected to the first end slope sheet and a second edge portion connected to the shear plate, the gusset plates being disposed in spaced parallel relation with respect to each other in an array which extends laterally with respect to the longitudinal axis of the car.

2. The railway hopper car as defined in claim 1, the car body further including a roof sheet secured along the upper margin of each arcuate side sheet;

a second end slope sheet interconnecting the first end slope sheet, arcuate side sheets, and the roof; and the vertical gusset plates extending from the union of the first and second end slope sheets to the shear plate.

3. The railway hopper car as defined in claim 1, the bolster web assembly comprising:

first and second lateral webs each having first and second side edge portions connected to the stub center sill and adjacent side sill, respectively, and having top and bottom edge portions connected to the shear plate and bolster beam, respectively.

4. The railway hopper car as defined in claim 3, the combination further including:

a side bearing brace assembly interconnecting the bolster beam, shear plate, and lateral bolster web.

5. The railway hopper car as defined in claim 4, the bolster web assembly comprising:

first and second longitudinal webs disposed intermediate the stub center sill and shear plate and being disposed in spaced relation to one another; and, a plurality of end webs being disposed intermediate the longitudinal webs in spaced relation to one another and interconnecting the first and second longitudinal webs, the longitudinal webs and end webs interconnecting the stub center sill and the shear plate.

6. A railway hopper car comprising:

a car body defined by opposite arcuate side sheets having a side sill extending longitudinally along the lower margin of each side sheet and at least one inclined end slope sheet partially defining an end hopper compartment; and, an end support structure for the end hopper compartment, the end support structure including a bolster assembly defined by a horizontally disposed shear plate having opposite end portions attached to the side sills, said shear plate forming a channel provided by a first laterally extending end portion forming a first end sill attached to said slope sheet and a second laterally extending end portion forming a second end sill spaced from said first end sill; a stub center sill disposed subjacent the shear plate in alignment with the longitudinal axis of the car body having an end portion attached to the slope sheet and having a side portion attached to the shear plate; a bolster beam extending laterally on either side of the stub center sill and interconnecting the stub center sill with each side sill; a vertical bolster web extending transversely to the longitudinal axis of the car on either side of the stub center sill and interconnecting the stub center sill, the shear plate, and the bolster beam; and, a plurality of gusset plates each having a first edge portion attached to the slope sheet and a second edge portion attached to the shear plate, the gusset plates projecting in perpendicular relation to the shear plate and being laterally spaced substantially in parallel relation with respect to each other in an array which extends laterally with respect to the longitudinal axis of the car.

7. A modular bolster assembly for attachment to an end hopper compartment of a railroad hopper car of the type including opposite arcuate side sheets having a side sill extending longitudinally along the lower margin of each side sheet, said modular bolster assembly comprising, in combination:

an inclined end slope sheet for closing the end hopper compartment;

a substantially horizontally disposed shear plate being substantially channel shaped as provided by a first upturned end portion forming a first end sill attached to the slope sheet and a second upturned end portion spaced from said first end portion and forming a second end sill, said shear plate having opposite side portions for attachment to the side sills;

a stub center sill disposed subjacent the shear plate in alignment with the longitudinal axis of the car having an end portion attached to the slope sheet and having a side portion attached to the shear plate;

a bolster beam extending laterally on either side of the stub center sill for interconnecting the stub center sill with each side sill;

a vertical bolster web assembly extending transversely to the longitudinal axis of the car on either side of the stub center sill and interconnecting the stub center sill, the shear plate, and the bolster beam; and, a plurality of gusset plates each having a first edge portion attached to the slope sheet and a second edge portion attached to the shear plate, the gusset plates being laterally spaced substantially in parallel relation with respect to each other in an array which extends laterally with respect to the longitudinal axis of the car.

8. The modular bolster assembly as defined in claim 7, the first vertical bolster web assembly comprising:

first and second lateral webs each having a first end portion attached to the stub center sill and each having a second end portion for attachment to the adjacent side sill, and having first and second side edge portions attached to the shear plate and bolster beam, respectively; and, a side bearing brace assembly interconnecting the bolster beam, shear plate, and lateral bolster web.

9. The modular bolster assembly as defined in claim 7 including:

a second vertical bolster web assembly interconnecting the stub center sill and the shear plate, the second vertical bolster web assembly being disposed intermediate the stub center sill and the shear plate and extending along the longitudinal axis of the car.

10. The modular bolster assembly as defined in claim 9, the second vertical bolster web assembly comprising:

first and second longitudinal webs being substantially coextensive in length with the shear plate, the first and second longitudinal webs being disposed in spaced, parallel relation to one another; and, a plurality of lateral webs being substantially coextensive with the width of the stub center sill, the later webs being disposed in spaced, parallel relation to one another and interconnecting the first and second longitudinal webs.

11. A modular bolster assembly for attachment to an end hopper compartment of a railway car of the type including generally arcuate side sheets having a side sill member extending longitudinally along the lower marginal portion of each side sheet, the modular bolster assembly comprising, in combination:

an inclined end slope sheet for closing the end hopper compartment;

a substantially horizontally disposed shear plate having spaced apart upturned integral end portions forming a channel shaped section, one of said end portions being attached to the slope sheet, and said shear plate having opposite side portions for attachment to the side sill members;

a plurality of vertical gusset plates each having upper terminal edges secured to the slope sheet and lower terminal edges secured to the shear plate, the vertical gusset plates projecting in perpendicular relation to the shear plate and being laterally spaced substantially in parallel relation with respect to each other in an array which extends laterally with respect to the longitudinal axis of the car; and, draft sill assembly means secured to the bolster assembly.

12. In a railway hopper car of the type including a car body defined by opposite arcuate side sheets having a side sill extending longitudinally along the lower margin of each side sheet and at least a first end slope sheet partially defining an end hopper compartment, the combination with the car body of an end support structure for the end hopper compartment, the end support structure including a bolster assembly comprising:

a substantially horizontally disposed shear plate having opposite side portions secured to the side sills and an end portion secured to the first end slope sheet;

a stub center sill disposed subjacent and connected to the shear plate substantially in alignment with the longitudinal axis of the car body;

a bolster beam extending transversely with respect to the longitudinal axis of the car body on either side of the stub center sill and interconnecting the stub center sill with each side sill;

a bolster web assembly interconnecting the stub center sill, the shear plate and the bolster beam;

a plurality of vertical gusset plates interconnecting the first end slope sheet and shear plate, each of the gusset plates having a first edge portion connected to the first end slope sheet and a second edge portion connected to the shear plate, the gusset plates being disposed in spaced parallel relation with respect to each other in an array which extends laterally with respect to the longitudinal axis of the car; and an end sill having opposite end portions connected to the side sills and a side edge portion connected to the shear plate, the end sill extending laterally with respect to the longitudinal axis of the car body;

and the gusset plates each have a third edge portion connected to the end sill.

* * * * *